US006588072B1

(12) United States Patent
Lin

(10) Patent No.: US 6,588,072 B1
(45) Date of Patent: Jul. 8, 2003

(54) ZIPPER SLIDE

(76) Inventor: Yu-Pau Lin, No. 151, Kung Erh Road, Wu Lin Tsuen, Lung Tan Hsiang, Tao Yuan Hsien (TW)

( * ) Notice: Subject to any disclaimer, the term of this patent is extended or adjusted under 35 U.S.C. 154(b) by 0 days.

(21) Appl. No.: 10/032,003

(22) Filed: Dec. 31, 2001

(51) Int. Cl.[7] ..... A44B 19/30

(52) U.S. Cl. ..... 24/421; 24/419; 24/416; 24/429; 24/426; 24/436

(58) Field of Search ..... 24/436, 428, 416, 24/421, 399, 419, 429, 430; 70/68; 294/3.6

(56) References Cited

U.S. PATENT DOCUMENTS 1,966,255 A * 7/1934 Marinsky ..... 24/419
2,095,270 A * 10/1937 Silberman ..... 24/436
2,530,438 A * 11/1950 Modrey ..... 70/68
2,855,652 A * 10/1958 Jones ..... 24/436
3,262,172 A * 7/1966 Scheuerman ..... 24/421
3,968,545 A * 7/1976 Kawashima ..... 24/429
4,121,326 A * 10/1978 Kamiya ..... 24/416
5,497,535 A * 3/1996 Kloor ..... 24/426
6,314,624 B1 * 11/2001 Lin ..... 24/421

* cited by examiner

*Primary Examiner*—Victor Sakran
(74) *Attorney, Agent, or Firm*—Rosenberg, Klein & Lee

(57) ABSTRACT

A zipper slide installed in two zipper tapes and moved to close/open interlocking teeth of the zipper tapes. The zipper slide includes a slide, the slide having a top plate and a bottom plate connected in parallel and two sliding ways bilaterally defined between the top plate and the bottom plate, the top plate and the bottom plate each having two horizontal flat extensions bilaterally disposed at one end and adapted to guide movement of the slide on the zipper tapes, the horizontal flat extensions each having front notch disposed at an inner side corresponding to the interlocking teeth of the zipper tapes, and a pull tab coupled to the top plate of the slide for pulling by hand.

7 Claims, 6 Drawing Sheets

ZIPPER SLIDE

BACKGROUND OF THE INVENTION

1. Field of the Invention

The present invention relates to a zip fastener and, more specifically, to zipper slide for zip fastener, which has means to guide movement of the slide on zipper tapes.

2. Description of the Related Art

FIG. 1 shows a zipper slide constructed according to the prior art. The zipper slide comprises a slide 10*a* coupled to the interlocking teeth 20*a* of zipper tapes, a pull tab 11*a* coupled to the slide 10*a* for pulling by hand to close/open the interlocking teeth 20*a* of the zipper tapes. The zipper slide further comprises a spring plate 12*a* fastened to the slide 10*a*. The spring plate 12*a* has a rear retaining portion 13*a* inserted through a hole in the top wall of the slide 10*a* and forced by the spring power of the spring plate 12*a* into engagement with the interlocking teeth 20*a* of the zipper tapes. When pulling to the pull tab 11*a* to move the slide 10*a*, the rear retaining portion 13*a* is disengaged from the interlocking teeth 20*a* of the zipper tapes so that the slide 10*a* can be moved with the pull tab 11*a* to along the zipper tapes to close/open the interlocking teeth 20*a*. This structure of zipper slide is still not satisfactory in function. Because the zipper tapes tend to be wrinkled with the fabric of the object in which the zip fastener is installed, the slide 10*a* may be jammed in the interlocking teeth of the zipper tapes when pulling the pull tab 11*a*.

SUMMARY OF THE INVENTION

The present invention has been accomplished to provide a zipper slide, which eliminates the aforesaid problem. It is one object of the present invention to provide a zipper slide, which has means to guide movement of the slide on the zipper tapes and to keep the zipper tapes in a smooth manner when pulling the sipper slide to close/open the interlocking teeth of the zipper tapes. To achieve this and other objects of the present invention, the zipper slide comprises a slide, the slide having a top plate and a bottom plate connected in parallel and two sliding ways bilaterally defined between the top plate and the bottom plate, the top plate and the bottom plate each having two horizontal flat extensions bilaterally disposed at one end and adapted to guide movement of the slide on the zipper tapes, the horizontal flat extensions each having front notch disposed at an inner side corresponding to the interlocking teeth of the zipper tapes, and a pull tab coupled to the top plate of the slide for pulling by hand.

DETAILED DESCRIPTION OF THE PREFERRED EMBODIMENT

Figure 1:
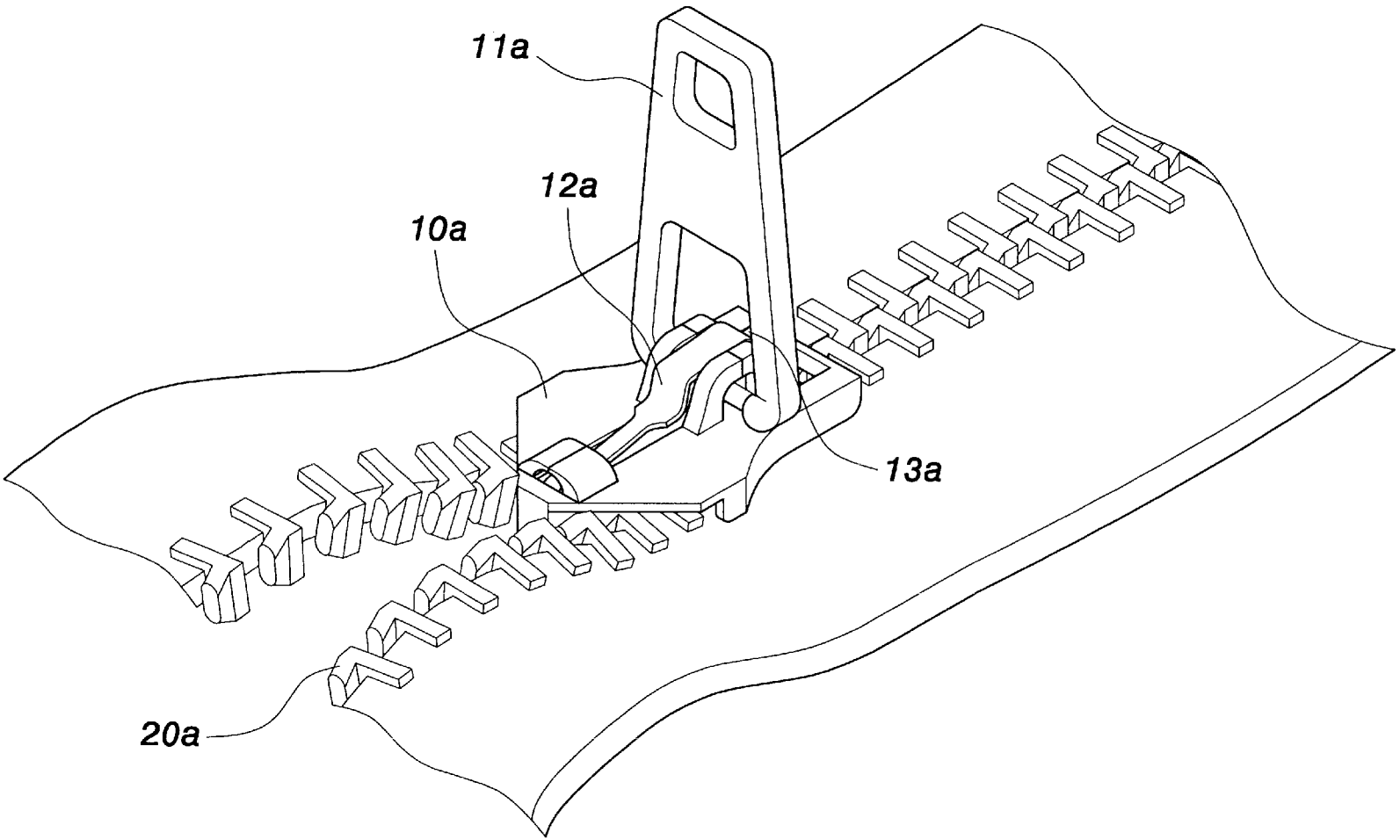
FIG. 1 PRIOR ART
FIG. 1 is a perspective view showing a zipper slide installed in zipper tapes according to the prior art.
Figure 2:
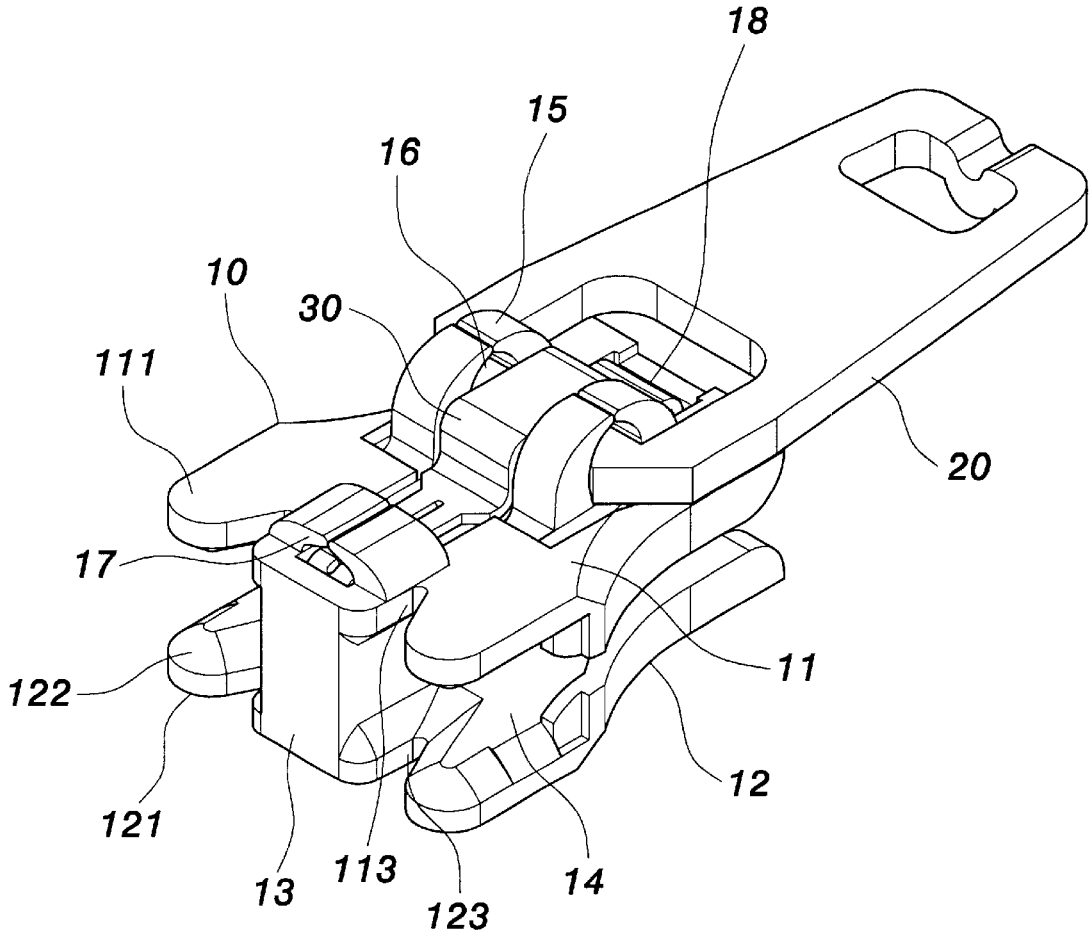
FIG. 2 is a perspective view of a zipper slide constructed according to the present invention.
Figure 3:
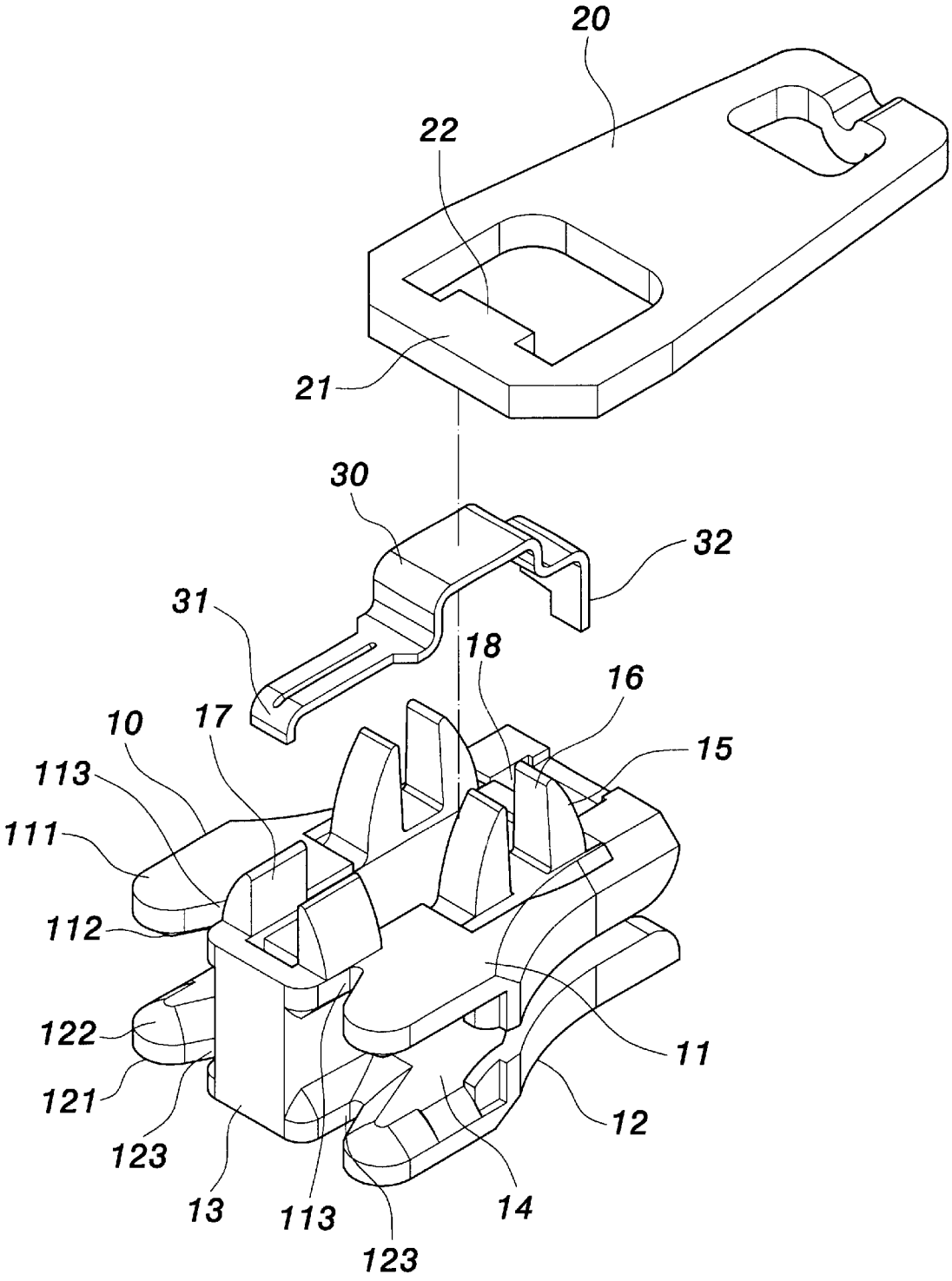
FIG. 3 is an exploded view of the zipper slide according to the present invention.
Figure 4:
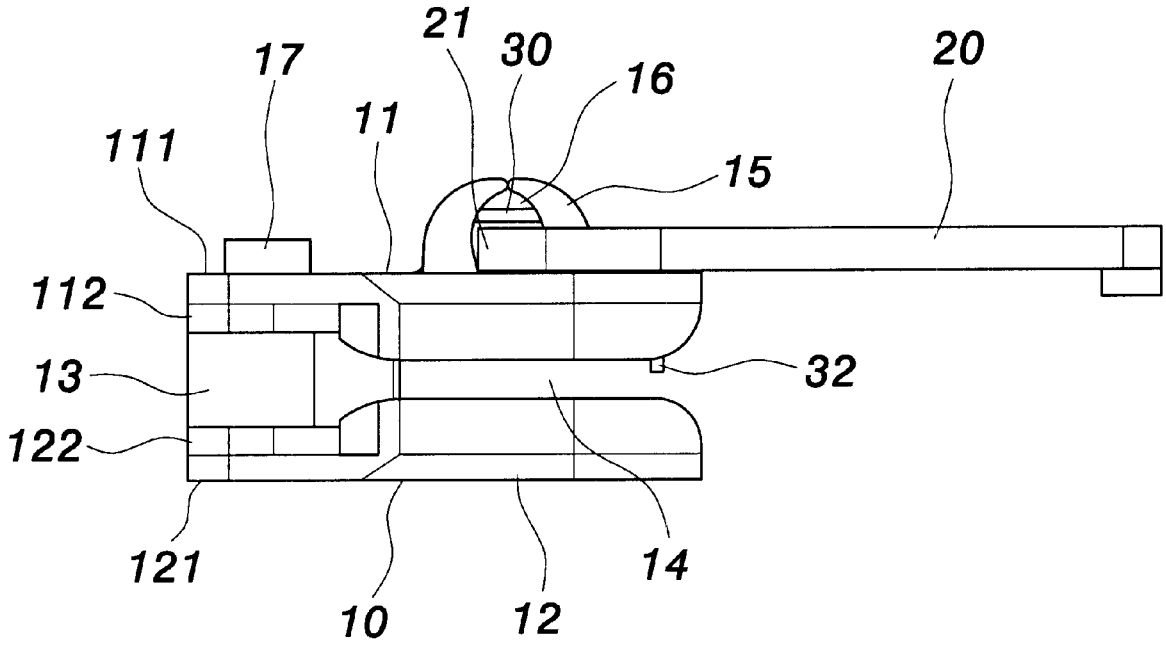
FIG. 4 is a side view of the zipper slide according to the present invention.
Figure 5:
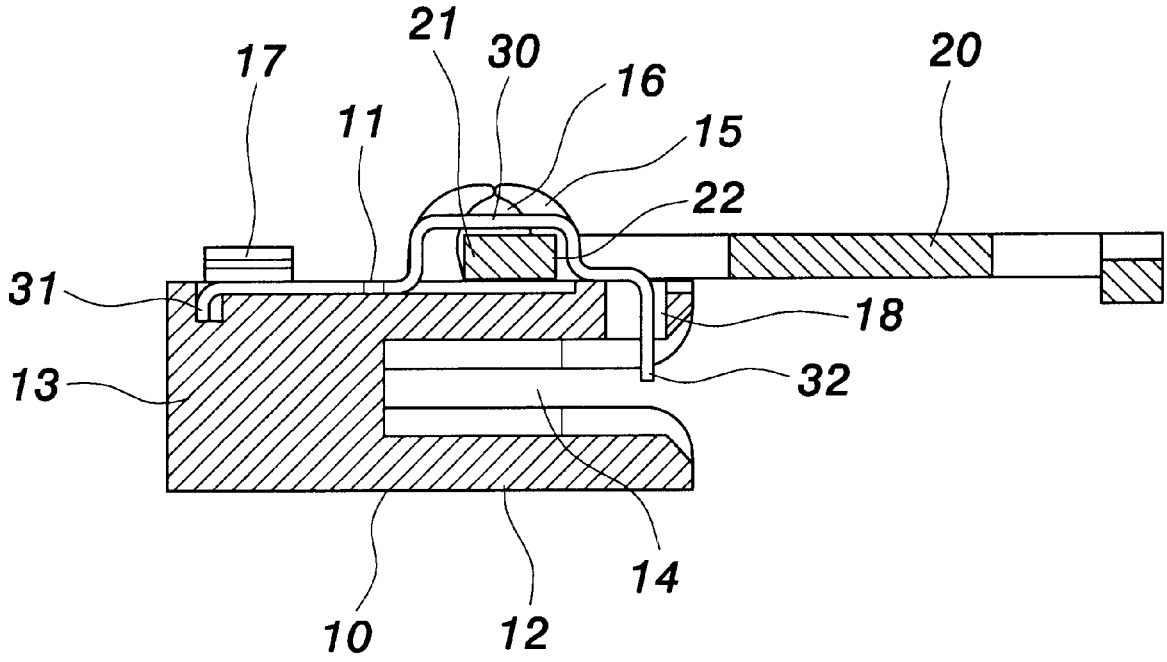
FIG. 5 is a sectional view of the zipper slide according to the present invention.

Referring to FIGS. from 2 through 5, a zipper slide in accordance with the present invention is a self-locking zipper slide that can be made of metal or plastics, comprised of a slide 10, a pull tab 20, and a spring plate 30.

The slide 10 comprises a top plate 11, a bottom plate 12, a vertical connecting block 13 connected between the top plate 11 and the bottom plate 12, two sliding ways 14 bilaterally defined between the top plate 11 and the bottom plate 12 at two sides of the vertical connecting block 13 and adapted for receiving the interlocking teeth of the zipper tapes, two coupling blocks 15 bilaterally disposed at the top side of the top plate 11, each coupling block 15 defining a coupling hole 16, two locating plates 17 disposed at the top side of the top plate 11 near one end, and a through hole 18 disposed in the other end of the top plate 11.

The pull tab 20 is a flat elongated plate comprising a loop-like coupling head 21 disposed at one end and pivotally coupled to the coupling holes 16 of the coupling blocks 15 of the slide 10, and a stop block 22 suspended in the loop-like coupling head 21.

The spring plate 30 is made of material having high spring power and inserted in between the coupling blocks 15, having a front mounting portion 31 fastened to the locating plates 17 and a rear retaining portion 32 inserted through the through hole 18 into the slide ways 14 and adapted to stop the interlocking teeth of the zipper tapes.

Referring to FIGS. from 2 through 5 again, the top plate 11 and bottom plate 12 of the slide 10 each comprise two horizontal flat extensions 111 or 121 bilaterally disposed at one end. The horizontal flat extensions 111 or 121 each have a front guide face 112 or 122, and a V-notch 113 or 123 at an inner side of the front guide face 112 or 122.

Figure 6:
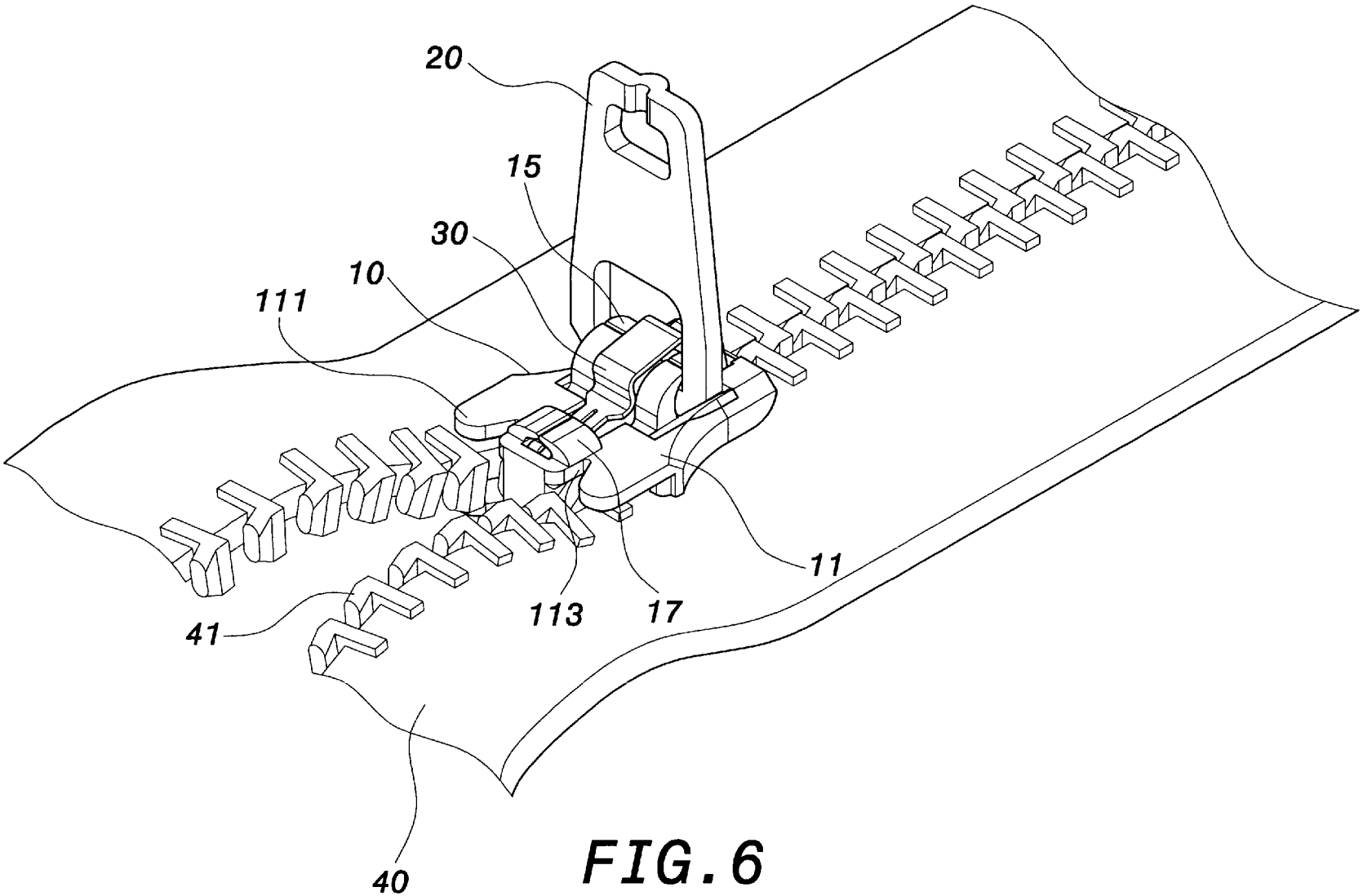
FIG. 6 shows the zipper slide installed in zipper tapes according to the present invention.

Referring to FIG. 6, by means of the slide ways 14, the slide is coupled to the zipper tapes 40. After the slide 10 has been fastened to the zipper tapes 40, the user can pull the pull tab 20 to close/open the interlocking teeth 41 of the zipper tapes 40. When pulling the pull tab 20, the stop block 22 of the pull tab 20 is pressed at the spring plate 30 to deform the spring plate 30 and to disengage the rear retaining portion 32 of the spring plate 30 from the interlocking teeth 41 of the zipper tapes 40, and therefore the pull tab 20 can be smoothly pulled to close/open the interlocking teeth 41 of the zipper tapes 40. ON the contrary, when the hand released from the pull tab 20, the spring plate 30 immediately returns to its former shape, forcing the rear retaining portion 32 into engagement with the interlocking teeth 41 of the zipper tapes 40 again.

Further, when moving the slide 20 to close/open the interlocking teeth 41 of the zipper tapes 40, the horizontal flat extensions 111 and 121 touch the zipper tapes 40 at first, keeping the zipper tapes 40 in a smooth manner between the horizontal flat extensions 111 and 121 of the top plate 11 and bottom plate 12 of the slide 10. The V-notches 113 provide a space for the interlocking teeth 41, preventing jamming of the horizontal flat extensions 111 and 121 in the interlocking teeth 41 of the zipper tapes 40.

A prototype of zipper slide has been constructed with the features of the annexed drawings of FIGS. 2~6. The zipper slide and pull tab arrangement functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A zipper slide installed in two zipper tapes and moved to close/open interlocking teeth of the zipper tapes, comprising:

a slide having a top plate and a bottom plate connected in parallel, a pair of locating plates and two pair of coupling blocks disposed at a top side of said top plate, two sliding ways bilaterally defined between said top plate and said bottom plate, said top plate and said bottom plate each having two horizontal flat extensions adapted to guide movement of said slide on said zipper tapes, said horizontal flat extensions each having front notch disposed at an inner side corresponding to the interlocking teeth of said zipper tapes;

a pull tab coupled to said coupling blocks of the top plate of said slide for pulling by hand; and a spring plate having a front mounting portion fastened to said locating plates and a rear retaining portion insertable into said sliding ways of said slid for engaging said interlocking teeth of said zipper tapes.

2. The zipper slide as claimed in claim 1, wherein said top plate comprises two top coupling blocks disposed at two sides; said pull tab comprises a coupling head pivoted to said top coupling blocks of said top plate.

3. The zipper slide as claimed in claim 1, wherein said top plate of said slide has a through hole near one end thereof through which the rear retaining portion insertable of said spring pate is forced into said sliding ways of said slide.

4. The zipper slide as claimed in claim 1, wherein said slide comprises a connecting block connected between said top plate and said bottom plate.

5. The zipper slide as claimed in claim 1, wherein said horizontal flat extensions of said top plate and said bottom plate of said slide each comprise a guide face adapted to guide movement of said slide on said zipper tapes.

6. The zipper slide as claimed in claim 1, wherein said horizontal flat extensions of said top plate and said bottom plate are respectively disposed at two sides of one end each of said top plate and said bottom plate.

7. The zipper slide as claimed in claim 1, wherein said front notch is a V-shaped notch.

* * * * *